US008334655B2

(12) United States Patent
Nien et al.

(10) Patent No.: US 8,334,655 B2
(45) Date of Patent: Dec. 18, 2012

(54) LAMP DEVICE AND LIGHT SOURCE MODULE WITH COIL CONNECTING TUBE

(75) Inventors: Sung-Mu Nien, Hsin-Chu (TW); Yen-Lin Lee, Hsin-Chu (TW); Shih-Che Fu, Hsin-Chu (TW); Hsuan-Hao Hsu, Hsin-Chu (TW)

(73) Assignee: Au Optronics Corporation, Hsin-Chu (TW)

( * ) Notice: Subject to any disclaimer, the term of this patent is extended or adjusted under 35 U.S.C. 154(b) by 224 days.

(21) Appl. No.: 12/755,730

(22) Filed: Apr. 7, 2010

(65) Prior Publication Data

US 2010/0259149 A1 Oct. 14, 2010

(30) Foreign Application Priority Data

Apr. 8, 2009 (TW) ..... 98111638 A

(51) Int. Cl.
*H01J 5/50* (2006.01)
*H01J 5/52* (2006.01)

(52) U.S. Cl. ..... 313/623; 313/50; 313/234; 313/318.1; 439/841; 439/788; 439/33; 362/97.1; 362/378

(58) Field of Classification Search ..... 313/623–625, 313/318.01–318.12, 607, 234, 49–51; 439/33, 439/841, 788; D26/140; 362/97.1–97.2, 362/378
See application file for complete search history.

(56) References Cited

U.S. PATENT DOCUMENTS

| | | | | |
|---|---|---|---|---|
| 672,764 | A | 4/1901 | Harris | |
| 7,070,298 | B2 | 7/2006 | Mai | |
| D594,592 | S * | 6/2009 | Ohmori | D26/140 |
| D594,593 | S * | 6/2009 | Ohmori et al. | D26/140 |
| 2004/0166701 | A1 | 8/2004 | Sasaki | |
| 2009/0098744 | A1 * | 4/2009 | Ohmori et al. | 439/33 |
| 2009/0156026 | A1 * | 6/2009 | Ohmori | 439/81 |
| 2010/0055976 | A1 * | 3/2010 | Ohmori et al. | 439/567 |

FOREIGN PATENT DOCUMENTS

| | | |
|---|---|---|
| CN | 1522481 | 8/2004 |
| CN | 101409186 | 4/2009 |
| JP | 2002-093376 | 3/2002 |
| TW | 495798 | 10/1989 |
| TW | I226650 | 11/1989 |

(Continued)

OTHER PUBLICATIONS

Chinese language office action dated Mar. 11, 2010.

English language translation of abstract and pertinent parts of CN 101409186 (published Apr. 15, 2009).

(Continued)

*Primary Examiner* — Mariceli Santiago
(74) *Attorney, Agent, or Firm* — McClure, Quarley & Rodack, LLP

(57) ABSTRACT

A lamp device and a light source module are provided. The lamp device includes a lamp body and a coil connecting tube. The lamp body has an end portion and a lead wire extends from the end portion. The coil connecting tube is disposed corresponding to the end portion of the lamp body and electrically connecting to the lead wire for power supply purpose. The coil connecting tube winds about an axial direction of the lamp body and is capable of stretching or compressing along the axial direction. The light source module includes the lamp device and a lamp connector which has a power source portion being coupled to the coil connecting tube for power supply.

24 Claims, 16 Drawing Sheets

FOREIGN PATENT DOCUMENTS

| | | |
|---|---|---|
| TW | I226493 | 11/1992 |
| TW | M276218 | 9/2005 |
| TW | 200743859 | 12/2007 |
| TW | 200844569 | 11/2008 |

OTHER PUBLICATIONS

English language translation of abstract of TW 495798.
Taiwan Office Action dated Jul. 20, 2012.

* cited by examiner

LAMP DEVICE AND LIGHT SOURCE MODULE WITH COIL CONNECTING TUBE

BACKGROUND OF THE INVENTION

1. Field of the Invention

This invention relates to a lamp and a light source module and more specifically to a lamp device and a light source module for use in backlight modules.

2. Description of the Prior Art

Backlight modules are widely used in electronic products such as liquid crystal displays to provide the luminance required. Recently, the backlight module technology improves as the demand for liquid crystal displays increases. As for conventional backlight module on the market, lamps used to provide luminance are inexpensive and thus are the main light source for the backlight module.

In conventional design, an end portion of the lamp is inserted into the connector on a base plate during assembly and then the lead wire extended from the lamp electrode is soldered with terminals on the connector. From the perspective of manufacture, the above-mentioned design is difficult to realize in practice. Furthermore, it is often difficult to dissemble when the product is defective and needs to be reworked. FIG. 1A and FIG. 1B are schematic views of conventional design proposed to solve the above-mentioned problem. As FIG. 1A shows, a lead wire 13 extends from an end portion 11 of the lamp 10. A metal cap 30 is disposed on the end portion 11 of the lamp 10 and the metal cap 30 is soldered with the lead wire 13 to establish an electrical connection. When the lamp 10 is assembled in the backlight module, only the end portion 11 and the metal cap 30 are required to be inserted into a retainer 51 of the connector 50 to establish an electrical connection with the retainer 51.

Higher temperature occurs at the end portion 11 of the lamp 10 when current flows through the end portion 11 and thus good heat dissipation is required in order to prolong the life of the lamp 10. As for the designs illustrated in FIG. 1A and FIG. 1B, the end portion 11 is covered by the metal cap 30 and thus heat is transmitted to the metal cap 30 and then dissipated through the surface of the metal cap 30. However, improvement can be made for the above-mentioned heat dissipation configuration. Furthermore, the metal cap 30 is held by the retainer 51 while the metal cap 30 tightly covers the end portion 11 of the lamp 10. In this way, in the case that the lamp 10 is held by the retainer 51, the end portion 11 of the lamp 10 and the retainer 51 will not move relative to each other axially or radially. Therefore, when external impact is exerted on the backlight module, two things will normally occur. Firstly, the external impact will be transferred from the retainer 51 to the metal cap 30 and then to the end portion 11 of the lamp 10 causing damages to the lamp 10. Secondly, the retainer 51 is unable to hold the end portion 11 of the lamp 10 and thus the lamp 10 may come off the retainer 51 and cause electrical disconnection.

SUMMARY OF THE INVENTION

It is an object of the present invention to provide a lamp device and a light source module which are easy to assemble.

It is another object of the present invention to provide a lamp device and a light source module having improved heat dissipation.

It is yet another object of the present invention to provide a lamp device and a light source module to prevent lamps from being damaged by external forces.

It is yet another object of the present invention to provide a lamp device and a light source module to reduce the possibility of causing the lamps to come off a lamp connector.

The lamp device of the present invention includes a lamp body and a coil connecting tube. The lamp body has an end portion and a lead wire, wherein the lead wire extends from the end portion. The coil connecting tube corresponds to the end portion of the lamp body and is disposed near the end portion. The coil connecting tube is electrically connected to the lead wire and transmits electricity from an external source to the lamp body. The coil connecting tube winds around the lamp body along an axial direction, i.e. the coil connecting tube winds around the axis of the lamp body. Furthermore, the coil connecting tube is contractible along the axial direction.

The light source module of the present invention includes the above-mentioned lamp device and a lamp connector. The lamp connector includes a power source portion electrically connected to the coil connecting tube and provides electricity to the coil connecting tube for the lamp body to emit light.

DETAILED DESCRIPTION OF THE PREFERRED EMBODIMENT

The present invention provides a lamp device and a light source module using the lamp device. In a preferred embodiment, the lamp device or the light source module of the present invention are used in a backlight module as a light source. In different embodiments, the lamp device or the light source module can be used in other electronic devices as light sources. Furthermore, the backlight module having the lamp device or the light source module of the present invention can be used in the liquid crystal device as a light source.

Figure 1A:
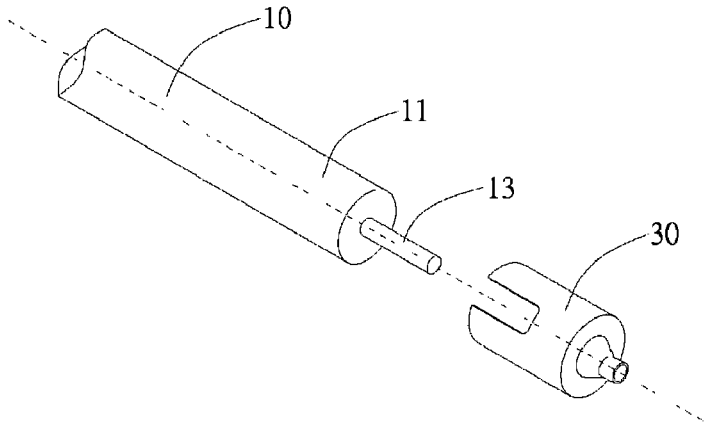
FIG. 1A (PRIOR ART)
FIG. 1A is a schematic view of a conventional lamp device.
Figure 1B:
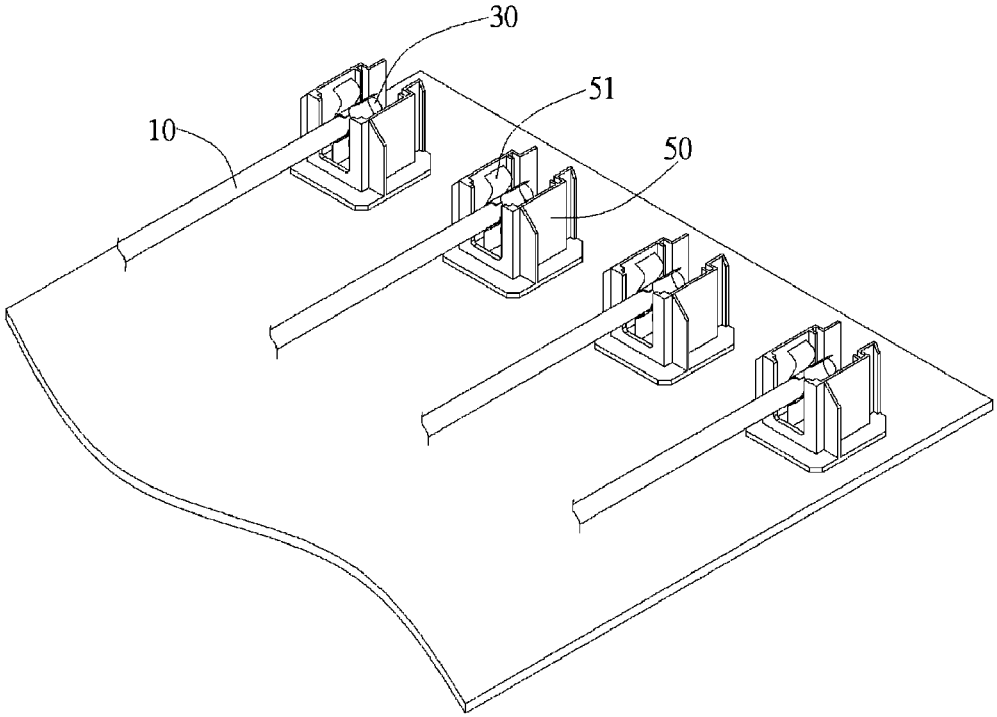
FIG. 1B (PRIOR ART)
FIG. 1B is a schematic view of a conventional backlight module.
Figure 2A:
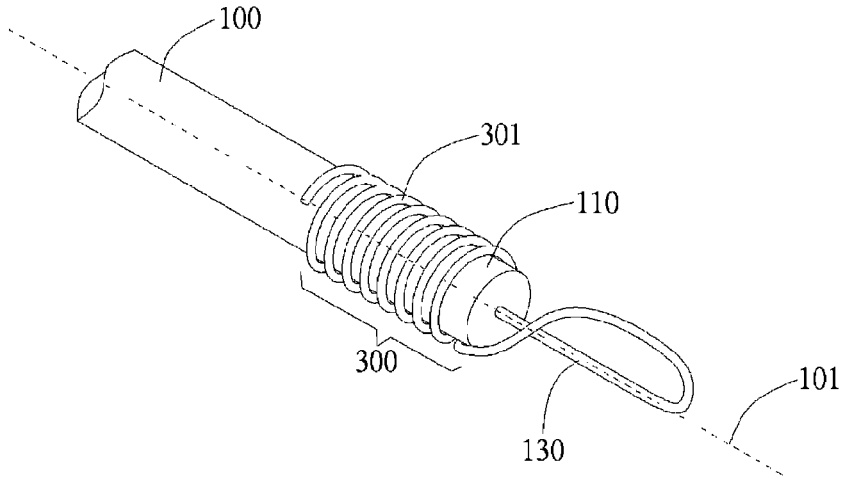
FIG. 2A is a schematic view illustrating an embodiment of the lamp device of the present invention.

As FIG. 2A shows, the lamp device of the present invention includes a lamp body 100 and a coil connecting tube 300. The lamp body 100 preferably includes cold cathode fluorescent lamps (CCFLs) or other types of lamps. The coil connecting tube 300 is preferably made by winding metal conducting wire to form a plurality of coils and a spiral structure similar to a spring. In preferred embodiments, the metal conducting wire used to form the coil connecting tube 300 includes stainless steel wire, piano wire, copper wire or other metallic wires.

Figure 2B:
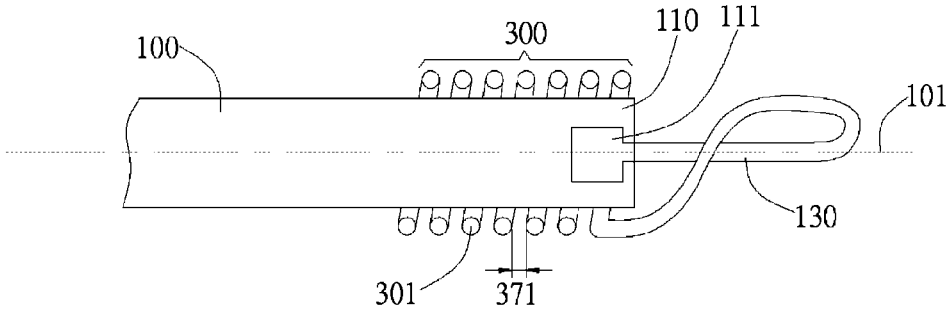
FIG. 2B is an axial cross-sectional view of the lamp device illustrated in FIG. 2A.

The lamp body 100 includes an end portion 110 and a lead wire 130. As FIG. 2A and FIG. 2B show, the end portion 110 of the lamp body 100 has an electrode 111 whereas the lead wire 130 is connected to the electrode and extends outward from the end portion 110. The position of the coil connecting tube 300 corresponds to the end portion 110 of the lamp body 100 and is close to the end portion 110. The coil connecting tube 300 is electrically connected to the lead wire 130 to relay electricity from an external power source to the lamp body 100. In a preferred embodiment, as FIG. 2A and FIG. 2B show, the coil connecting tube 300 is soldered to the lead wire 130 to establish an electrical connection. However, in different embodiments, the coil connecting tube 300 can be detachably connected to the lead wire 130 to establish the electrical connection. Furthermore, as FIG. 2A and FIG. 2B show, the coil connecting tube 300 winds around the lamp body 100 along an axial direction 101 of the lamp body 100. In other words, the axial direction 101 is the axis of rotation of the coil connecting tube 300. In a preferred embodiment, the lamp body 100 and the coil connecting tube 300 are coaxial and the coil connecting tube 300 can be elastically or inelastically extensible or compressible along the axial directions.

In a preferred embodiment, as FIG. 2A and FIG. 2B show, the coil connecting tube 300 at least partly covers the end portion 110 of the lamp body 100. The coil connecting tube 300 consists of a plurality of continuous coils 301. In this way, the effective heat dissipation area of the coil connecting tube 300 is the sum of the surface areas of the coils 301 covering the end portion 110 and greater than that of the metal cap used in conventional design. Thus it can be seen, the use of the coil connecting tube 300 can efficiently dissipate heat generated at the end portion 110 of the lamp body 100 to prevent the occurrence of overheat. Furthermore, in the embodiment illustrated in FIG. 2A, the coil connecting tube 300 is formed by winding the lead wire 130 around the end portion 110 of the lamp body 100. As FIG. 2A shows, the lead wire 130 extends away from the end portion 110 and away from the lamp body 100, thus the lead wire 130 can be bent toward the lamp body 100 and then wound around the end portion 110.

As described above, the coil connecting tube 300 consists of a plurality of connected coils 301 and an interval exists between adjacent coils. As FIG. 2B shows, the interval allows the coil connecting tube 300 to be compressed under axial pressing forces and extended under axial pulling forces. However, in different embodiments, the coil connecting tube 300 can have no interval 371 between coils, i.e. the interval 371 is substantially equal to zero. In this way, the coil connecting tube 300 cannot be further compressed under axial pressing forces but can still extend under axial pulling forces. In addition, the increase contact area between adjacent coils 301 in turn increases the overall conductivity of the coil connecting tube 300.

Figure 3:
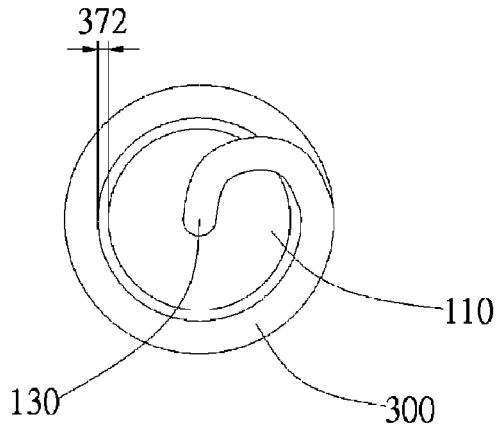
FIG. 3 is a radial cross-sectional view of the lamp device illustrated in FIG. 2A.

As FIG. 3 shows, the portion of the coil connecting tube 300 covering the end portion 110 of lamp body 100 has a circular cross-section identical to that of the lamp body 100. However, in different embodiments, the cross-section of the coil connecting tube 300 can be different from that of the lamp body 100 to accommodate different design requirements. Furthermore, the inner rim of the coils 301 covering the end portion 110 preferably does not directly contact the end portion 110 and a ring-shape gap 372 exists between the inner rim of the coils 301 and the exterior wall of the end portion 110. The above-mentioned design decreases the friction between the coil connecting tube 300 and the end portion 110 and prevents damages to the lamp body 100. Thus when the external force is exerted on the lamp device, the portion of the coil connecting tube 300 can move axially and slightly radially relative to the lamp body 100 and at the same time maintains the connection with the lead wire 130. Furthermore, the above-mentioned design allows the coil connecting tube 300 to provide support and cushion to protect the end portion 110 under external radial forces.

Figure 4:
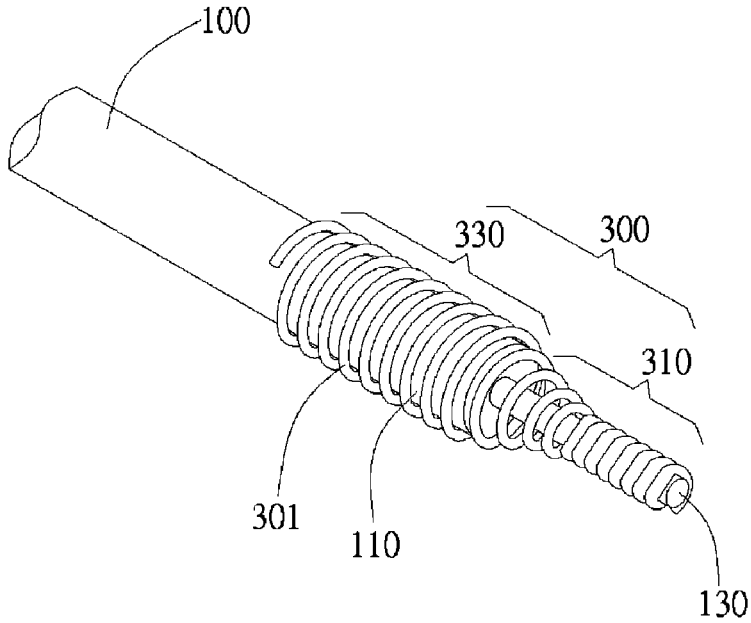
FIG. 4 is a schematic view illustrating another embodiment of the lamp device.

In the embodiment illustrated in FIG. 4, the coil connecting tube 300 includes a lead wire segment 310 and a lamp enclosing segment 330. The lead wire segment 310 winds around and is electrically connected to the lead wire 130. The inner rim is in direct contact with the lead wire 130 to establish an electrical connection. In a preferred embodiment, the lead wire segment 310 can be pressed or clipped to connect with the lead wire 130 so that the lead wire segment 310 holds the lead wire 130. However, in different embodiments, the lead wire segment 310 can be connected to the lead wire 130 using other methods such as soldering, laser fusing, high pressure fusing, etc. Furthermore, in a preferred embodiment, the lead wire segment 310 can be made of material different from that of the lead wire 130 to increase heat dissipation effect, electrical conductivity or other desired effects.

As FIG. 4 shows, the lamp enclosing segment 330 is formed by winding the lead wire segment 310 about the axis of the end portion 110 of the lamp body 100 and the lamp enclosing segment 330 encloses the end portion 110. In the present embodiment, a gap exists between the inner rim of the lamp enclosing segment 330 and the end portion 110. Thus, although the lead wire segment 310 and the lead wire 130 are tightly coupled, the lamp enclosing segment 330 can still move axially relative to the end portion 110. Furthermore, the diameter of the lamp body 100 is greater than that of the lead wire 130 and therefore the diameter of the lamp enclosing segment 330 is greater than that of the lead wire segment 310. Compared with the embodiment illustrated in FIG. 2, the coil connecting tube having the lead wire segment 310 and the lamp enclosing segment 330 of the present embodiment can be made separately and then assembled with the lamp body 100. The end portion 110 of the lamp body 100 is inserted from the lamp enclosing segment 330 to allow the lead wire 130 to be inserted into the lead wire segment 310. Then, various methods described above are used to couple the lead wire 130 and the lead wire segment 310.

Figure 5:
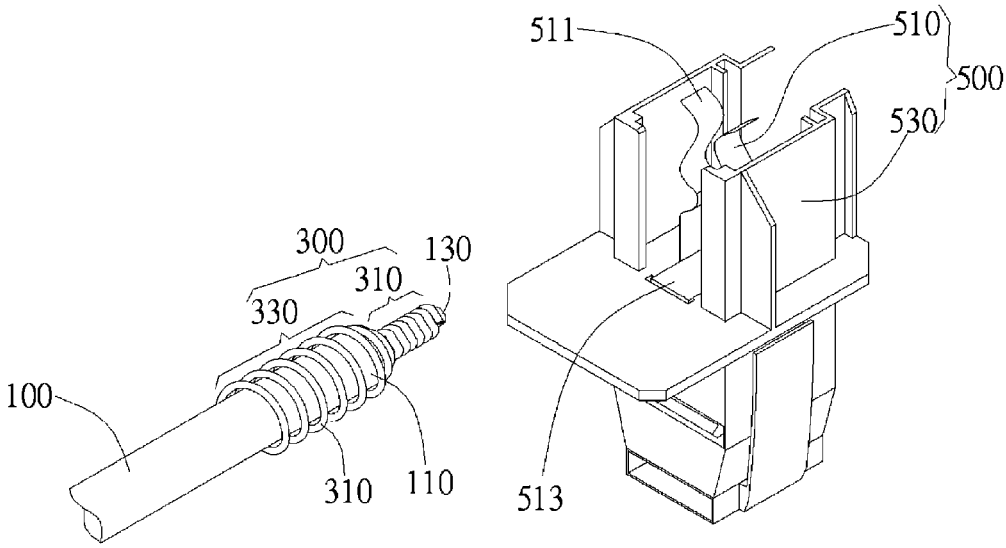
FIG. 5 is a schematic view illustrating a light source module including a lamp device and a lamp connector.

In the embodiment illustrated in FIG. 5, beside the above-mentioned lamp device, the light source module of the present invention also includes a lamp connector 500. The lamp connector 500 includes a power source portion 510 and an exterior frame 530. The end portion 110 of the lamp body 100 is inserted into the frame 530 to allow the coil connecting tube 300 to be electrically connected to the power source portion 510 to obtain power supply for the lamp body 100 to emit light. As FIG. 5 shows, the power source portion 510 of the present embodiment forms a retainer which includes holding portions 511 on at two sides and a bottom plate 513. The holding portion 511 extends upward from the bottom plate 513 and holds the portion of the coil connecting tube 300 enclosing the end portion 110 of the lamp body 100 or the exterior of the lamp enclosing segment 330. In a preferred embodiment, the holding portion 511 and the bottom plate 513 are made by processing a single metallic material through punching, stamping or other methods. The bottom plate 513 is connected to a power source (not illustrated) to obtain power supply.

Figure 6A:
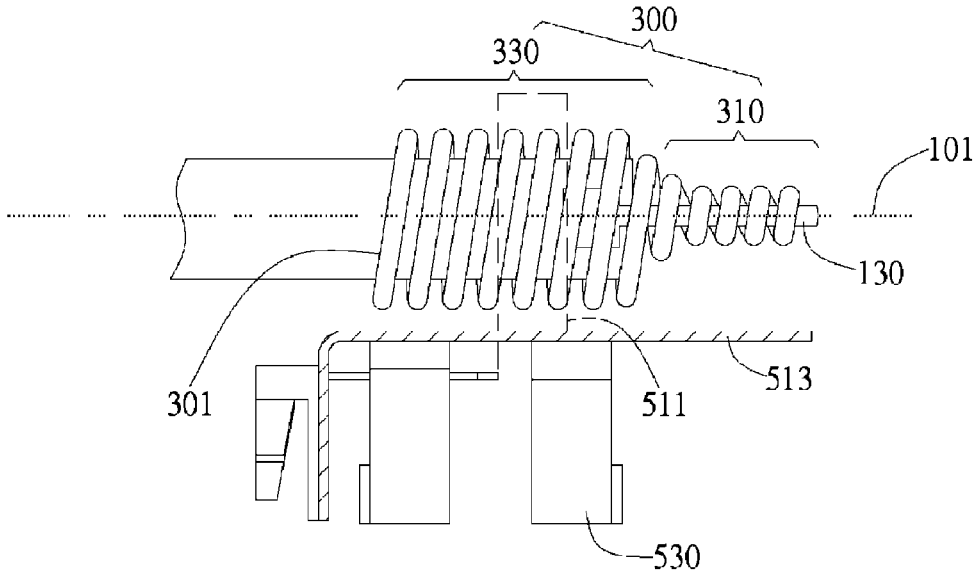
FIG. 6A is a cross-sectional view of a light source module including the assembly of the lamp device and a lamp connector.
Figure 6B:
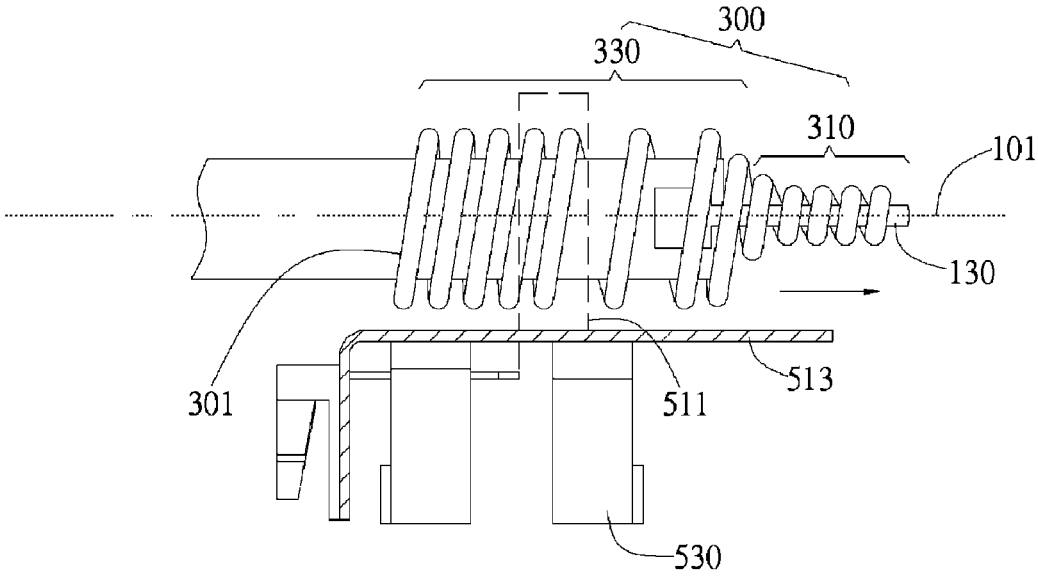
FIG. 6B is a schematic view of the light source module of FIG. 6A when an axial external force is applied thereto.
Figure 6C:
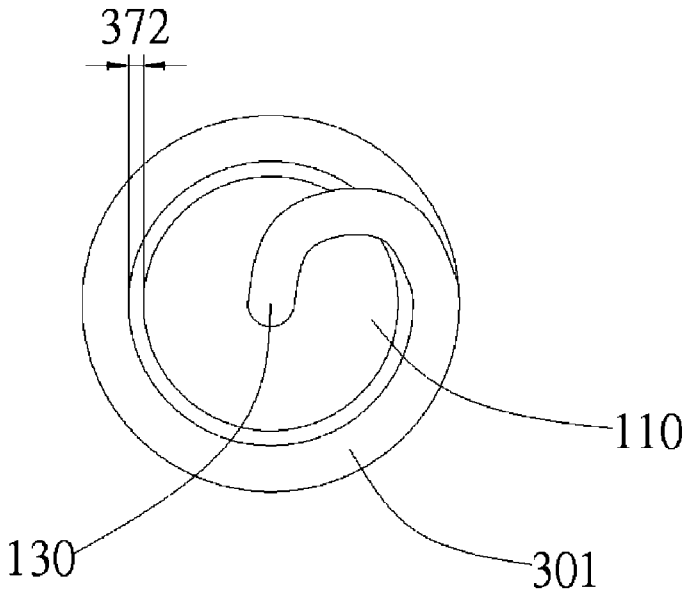
FIG. 6C is another cross-sectional view of the light source module illustrated in FIG. 6A.

As FIG. 6A and FIG. 6B, even when subjected to an external force, the holding portion 511 of the lamp connector 500 can firmly grip the lamp enclosing segment 330 while the lead wire segment 310 remains connected with the lead wire 130 and the lamp body 100. Furthermore, the elasticity or expandability of the coil connecting tube 300 provides cushion for the external force transmitted between the lamp body 100 and the holding portion 511. In other words, when the external force is transmitted from the lamp connector 500 to the end portion 110 of the lamp body 100, the coil connecting tube 300 will act as cushion and transform a portion of the external force into elastic potential energy of deforming the coil connecting tube 300. Therefore, the impact on the lamp body 100 and its end portion 110 can be reduced. Furthermore, as FIG. 6C shows, since the coil connecting tube 300 can resist the inward radial forces from the holding portion 511 and a gap 372 exists between the inner rim of each coil 301 and the end portion 110 of the lamp body 100 to protect the end portion 110 is protected from damage caused by the inward radial forces.

Figure 7A:
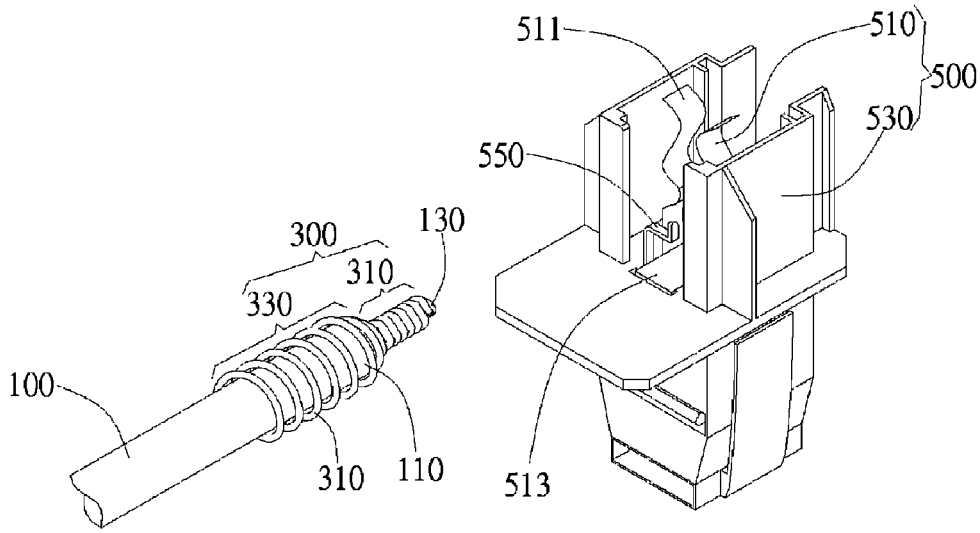
FIG. 7A and FIG. 7B are schematic views of another embodiment of the light source module having a positioning device.
Figure 7B:
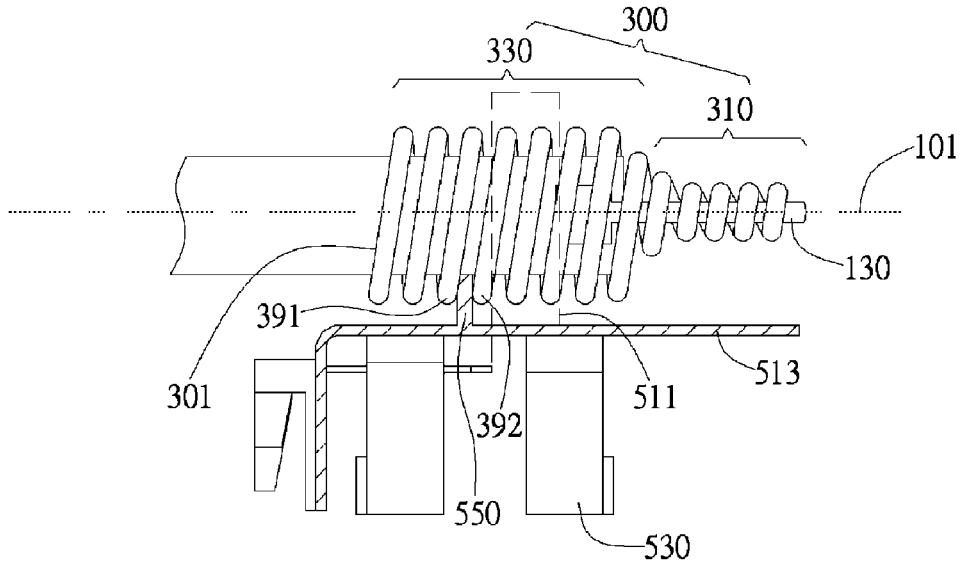

In the embodiment illustrated in FIG. 7A and FIG. 7B, the lamp connector 500 further includes a positioning device 550. In the present embodiment, the positioning device 550 extends from the bottom plate 513 of the retainer toward the end portion 110 of the lamp body 100. However, in different embodiments, the positioning device 550 extends from the frame 530 toward the end portion 110 of the lamp body 100. As FIG. 7A and FIG. 7B show, the coil connecting tube 300 includes a first coil 391 and a second coil 392 adjacent to each other and the positioning device 550 is a protrusion positioned between the first coil 391 and the second coil 392. When the light source module is subjected to external forces, the positioning device 550 can engage with or touch against the coils 391 or to allow the positioning device 550 to maintain the relative position between the lamp connector 500 and the coil connecting tube 300 and prevent the coil connecting tube 300 from coming off the holding portion 511.

Figure 8A:
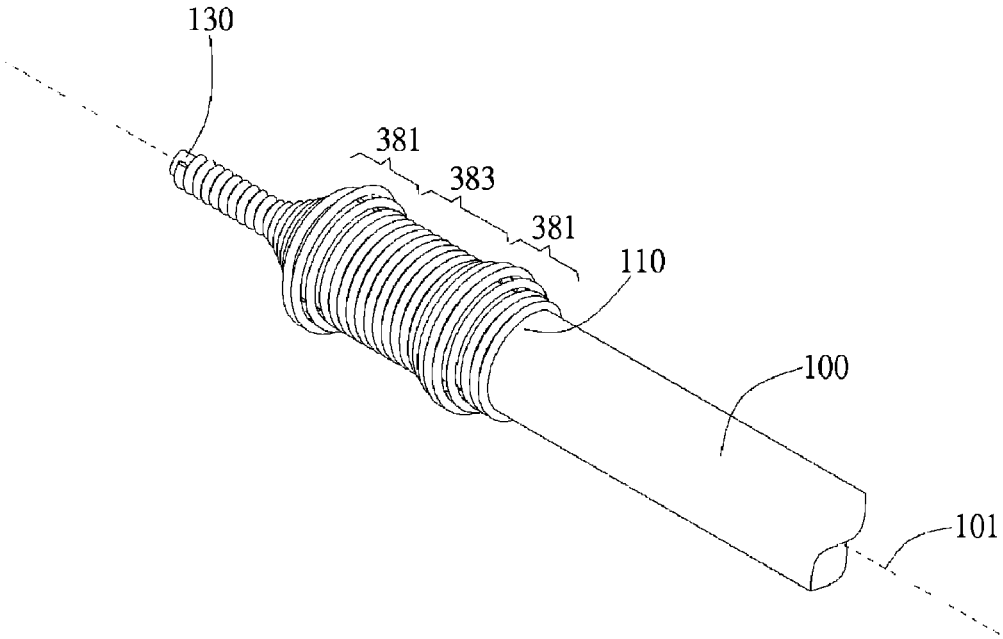
FIG. 8A is a schematic view illustrating another embodiment of the lamp device.
Figure 8B:
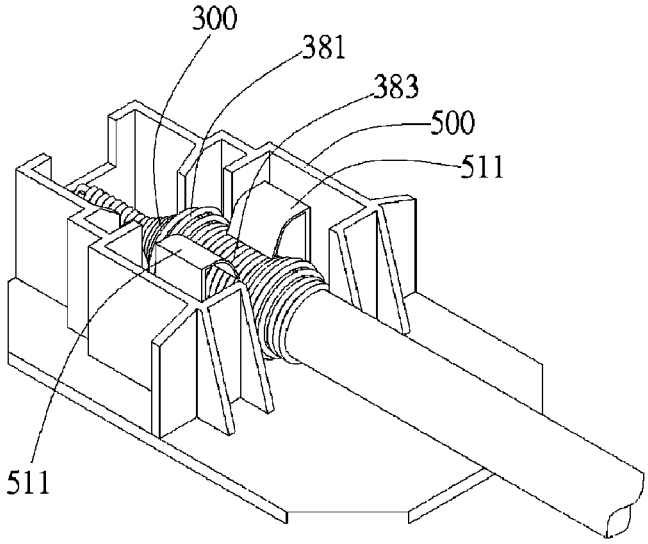
FIG. 8B is a schematic view of a light source module including the assembly combination of the lamp device and a lamp connector.
Figure 8C:
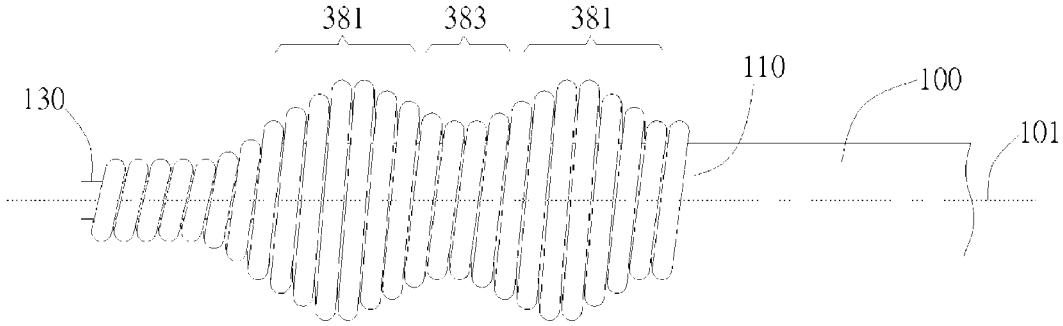
FIG. 8C is a schematic view illustrating an embodiment of a coil connecting tube.

As FIG. 8A shows, the portion of the coil connecting tube 300 enclosing the end portion 10 of the lamp body 100 includes at least one expanding portion 381 and at least one neck portion 383 alternately formed. In the present embodiment, the neck portion 383 is formed between two expanding portions 381, which are formed at two ends of the coil connecting tube 300. The average inner diameter of the expanding portion is greater than that of the neck portion and therefore the axial cross-section of the coil connecting tube 300 is distributed in a wave shape. When the coil connecting tube 300 couples with the lamp connector 500, as FIG. 8B shows, the holding portion 511 of the retainer preferably holds the neck portion 383. The expanding portion 381 having greater inner diameter can prevent the holding portion 511 from axially moving over the neck portion 383 and thus provides improved structure stability. However, in different embodiments, when the end portion 110 includes different number of the expanding portion 381 and the neck portion 383 or the expanding portion 381 and the neck portion 383 are arranged in different pattern, the holding portion 511 can be configured to grip the expanding portion 381 or the joint between the adjacent expanding portion 381 and neck portion 383. Furthermore, as FIG. 8C shows, the inner diameter of the expanding portion 381 and that of the neck portion 383 may increase or decrease along the axial direction. In other words, different portions of the expanding portion 381 or the neck portion 383 may have different diameter. The thickness of the expanding portion 381 and the neck portion 383 may gradually change along the axis of the lamp body 100. In the embodiment illustrated in FIGS. 8A, 8B and 8C, coils of the coil connecting tube 300 have substantially no interval between each other. In this way, the coil connecting tube 300 cannot be further compressed under axial pressing forces but can still extend under axial pulling forces. In addition, the increase contact area between adjacent coils 301 in turn increases the overall conductivity of the coil connecting tube 300. Furthermore, compressed coils allows more coils to be held by the holding portion 511. In this way, the contact area between the coil connecting tube 300 and the holding portion 511 is also increased.

Figure 9A:
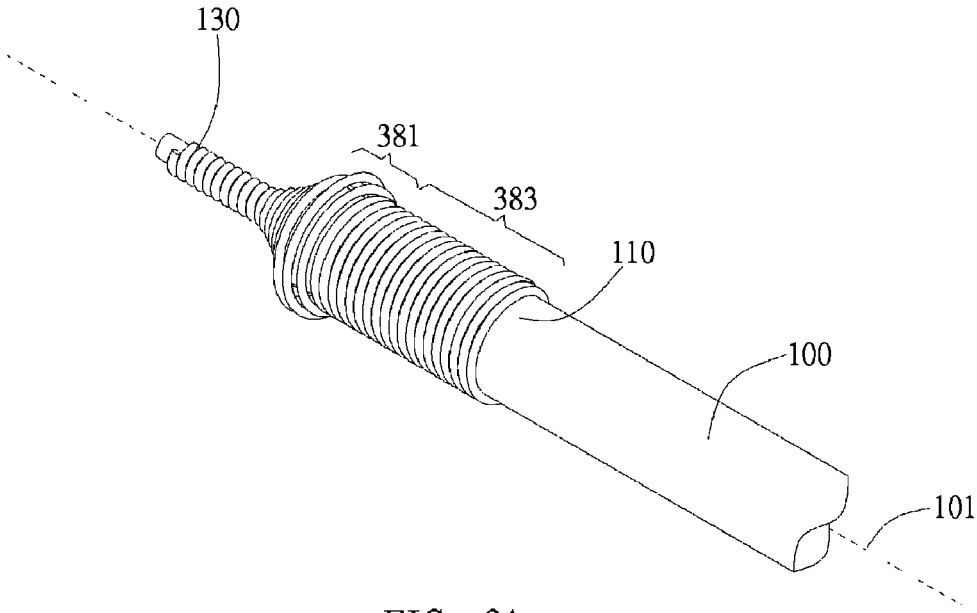
FIG. 9A is a schematic view of another embodiment of the lamp device.
Figure 9B:
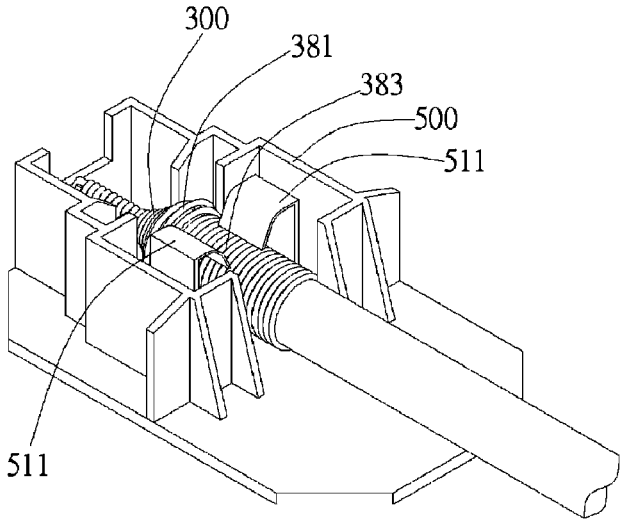
FIG. 9B is a schematic view illustrating the lamp device of FIG. 9A coupled with the lamp connector.

In the embodiment illustrated in FIG. 9A and FIG. 9B, the portion of the coil connecting tube 300 enclosing the end portion 110 includes a single expanding portion 381 and a neck portion 383. The expanding portion 381 is formed near the lead wire 130. When the coil connecting tube 300 is coupled with the lamp connector 500 as illustrated in FIG. 9B, the holding portion 511 of the retainer preferably holds the neck portion 383. The expanding portion 381 having a greater average radius can prevent the neck portion 383 from coming off holding portion 511 and provide the lamp device with greater structure stability.

Figure 10A:
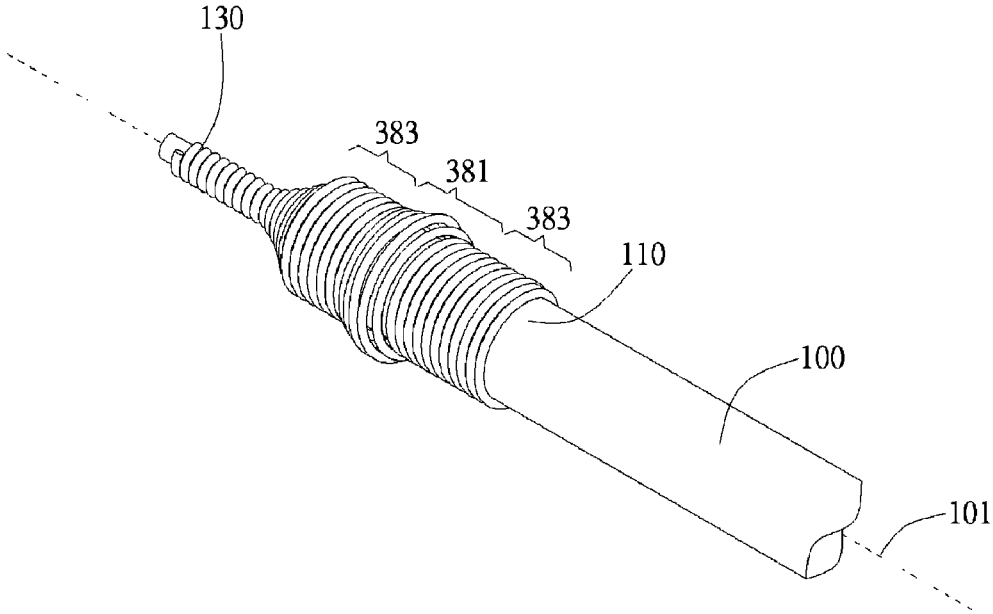
FIG. 10A is a schematic view illustrating another embodiment of the lamp device.
Figure 10B:
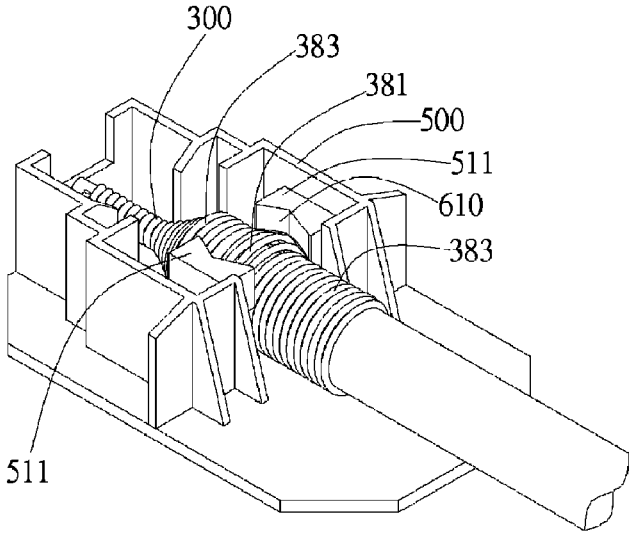
FIG. 10B is a schematic view illustrating the lamp device of FIG. 10A coupled with the lamp connector.
Figure 10C:
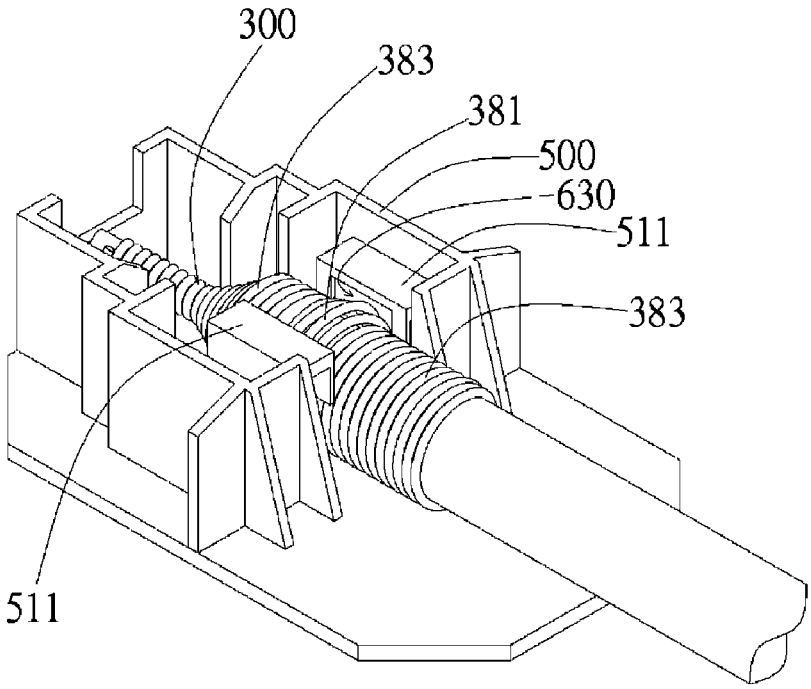
FIG. 10C is a schematic view illustrating another embodiment in which the lamp device of FIG. 10A is coupled with the lamp connector.

In the embodiment illustrated in FIG. 10A, the portion of the coil connecting tube 300 enclosing the end portion 110 of the lamp body 100 includes an expanding portion 381 while the rest of the coil connecting tube 300 are includes a neck portions 383. The expanding portion 381 is formed at the mid section of the coil connecting tube 300. As FIG. 10B shows, when the coil connecting tube 300 couples with the lamp connector 500, the holding portion 511 of the retainer holds the expanding portion 381. Corresponding to the geometry of the expanding portion 381, the holding portion 511 can have a recessed portion 610 to accommodate the expanded mid section of the expanding portion 381 and two ends of the recess portion 610 grips the expanding portion 381 in-between to maintain the relative position between the holding portion 511 and the coil connecting tube 300. Furthermore, in another embodiment illustrated in FIG. 10C, an opening 630 is formed on the holding portion 511 to accommodate the expanded section of the expanding portion 381 while the portion of the holding portion 511 next to the opening 630 holds two ends of the expanding portion 381 to establish an electrical connection and hold the coil connecting tube 300 in place.

Figure 11A:
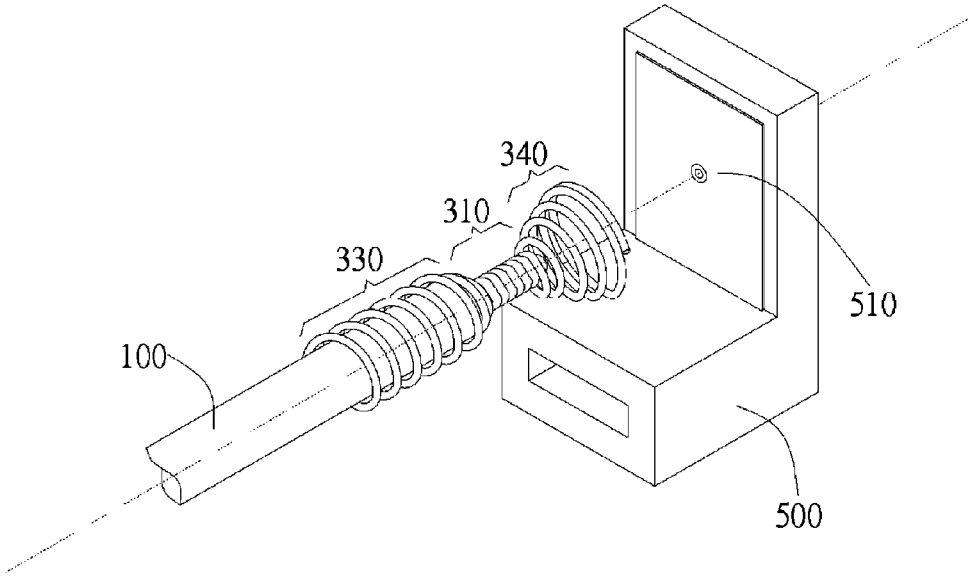
FIG. 11A is a schematic view illustrating a lamp device having an external extension.

In the embodiment illustrated in FIG. 11A, the coil connecting tube 300 further includes an external extension 340. The external extension 340 extends from the lead wire segments 310 in the axial direction opposite to the lamp enclosing segment 330. The external extension 340 protrudes axially away from the lead wire 130 as well as the end portion 110. However, in other embodiments, an angle can be included between the axis of the external extension 340 and that of the lead wire segment 310 or the lamp enclosing segment 330. Furthermore, of the end of the external extension which is connected to the lead wire segment 310 preferably has an inner diameter smaller than that of the free end of the external extension so that the external extension has a spiral-cone shape. In the present embodiment, the power source portion 510 of the lamp connector 500 can be a contact electrode. During assembly, the free end of the external extension presses against the power source portion 510 to establish an electrical connection. As FIG. 11A shows, the lead wire segment 310 provides the coil connecting tube 300 with the electrical connection with the lead wire 130 and partially support the weight of the lamp body 100. The lamp enclosing portion 330 further allows the coil connecting tube 300 to better support the lamp body 100. However, in different embodiments, the lamp enclosing portion 330 can be omitted so that the coil connecting tube 300 includes only the lead wire segment 310 and the external extension 340.

Figure 11B:
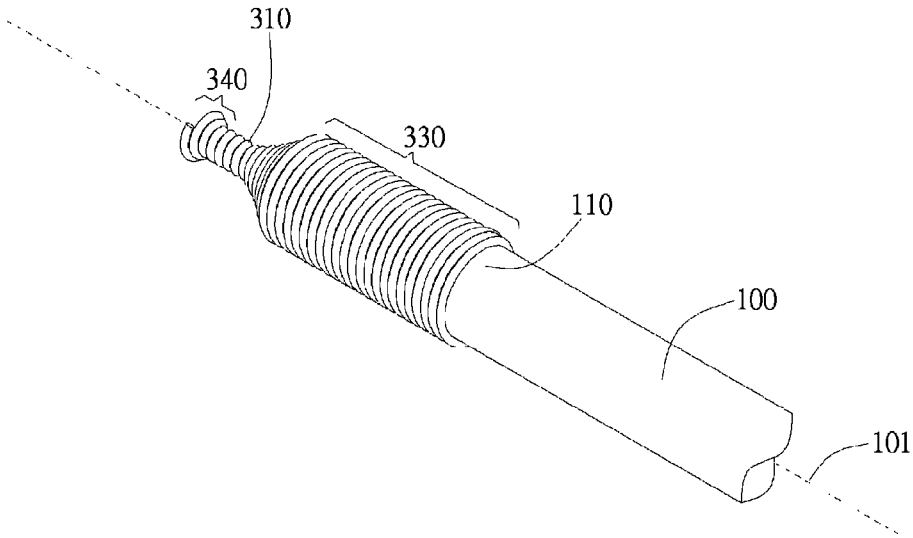
FIG. 11B is a schematic illustrating another embodiment of the lamp device including an external extension.
Figure 11C:
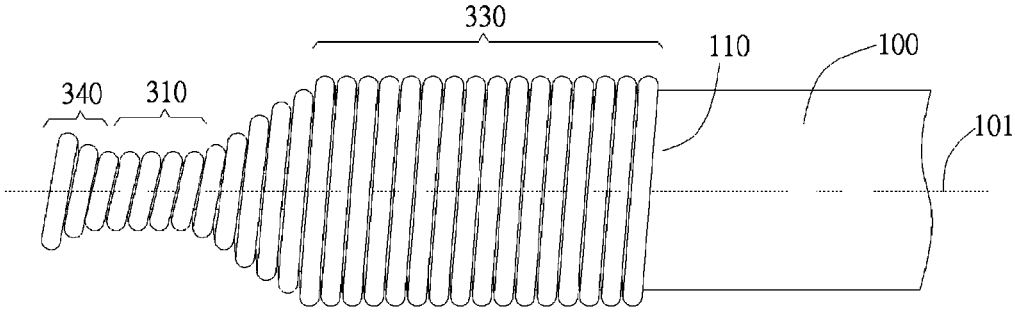
FIG. 11C is a side view illustrating the lamp device of FIG. 11B.

In the embodiment illustrated in FIG. 11B and FIG. 11C, the coil connecting tube 300 has a lead wire segment 310, a lamp enclosing portion 330 and an external extension 340. The coils of the coil connecting tube 300 are closely placed next to each other and no substantial gap exists between adjacent coils. The inner diameter of the external extension 340 gradually increases when extending away from the external extension 340. Overall, the average inner diameter of the external extension 340 is greater than that of the lead wire segment 310. When assembling the coil connecting tube 300 with the light source module, the electrical power can be obtained by connecting the external extension 340 with the power source or by coupling the holding portion with the lamp enclosing portion 330. In the embodiments illustrated in FIG. 11A, FIG. 11B and FIG. 11C, the lamp enclosing portion 330, the lead wire segment 310 and the external extension 340 are alternately disposed. Furthermore, the average inner diameter of the external extension 340 is greater than the average inner diameter of the lead wire segment 310. Thus, the lead wire segment 310 can be regarded as including the neck portion (illustrated in FIG. 8A) while the external extension 340 can be regarded as the expanding portion 381 (illustrated in FIG. 8A) extending from the lead wire segment 310 opposite to the lamp enclosing portion 330. In addition, the average inner diameter of the lamp enclosing portion 330 is greater than that of the lead wire segment 310. Thus the lamp enclosing portion 330 can also be regarded as including the expanding portion 381 (illustrated in FIG. 8A).

Figure 12:
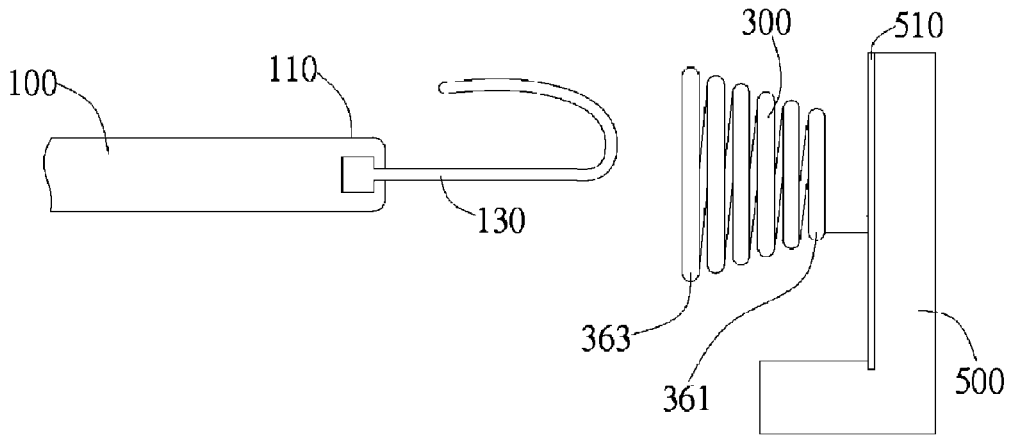
FIG. 12 is a schematic view illustrating another embodiment of the light source module.

FIG. 12 is a schematic view illustrating another embodiment of the light source module of the present invention. In the present embodiment, the coil connecting tube 300 includes a narrow end 361 and a wide end 363 opposite to each other. The coil connecting tube 300 is preferably included in the lamp connector 500 and the narrow end 361 is connected to the power source portion 510 to receive electricity. The end portion 110 of the lamp body 100 and the lead wire 130 are inserted into the coil connecting tube 300 through the wide end 363 and presses the coil connecting tube 300 to establish an electrical connection. As FIG. 12 shows, the lead wire 130 is bent to have a hook shape to increase the contact area with the coil connecting tube 300 and increases the electrical conductivity.

Figure 13:
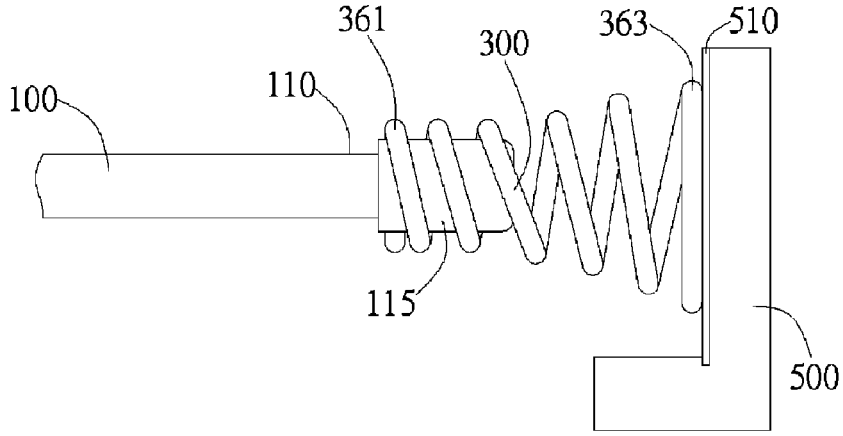
FIG. 13 is a schematic view illustrating a lamp device having external electrodes and a light source module.

In the embodiment illustrated in FIG. 13, the coil connecting tube 300 has a narrow end 361 and a wide end 363 opposite to each other. The coil connecting tube 300 is preferably connected to the lamp connector 500. However, the difference between the coil connecting tubes 300 illustrated in FIG. 12 and FIG. 13 is that the wide end 363 of the coil connecting tube 300 in FIG. 13 is connected to the power source portion 510 to receive electricity. Furthermore, the end portion 110 is covered with an external conductor 115 to form an external electrode. The end portion 110 of the lamp body 100 is inserted into the coil connecting tube 300 through the narrow end 361 while the inner rim of the narrow end 361 grips the external conductor 115 at the end portion 110 of the lamp body 100 to achieve the electrical transmission from power source portion 510 to the lamp body 100.

Figure 14A:
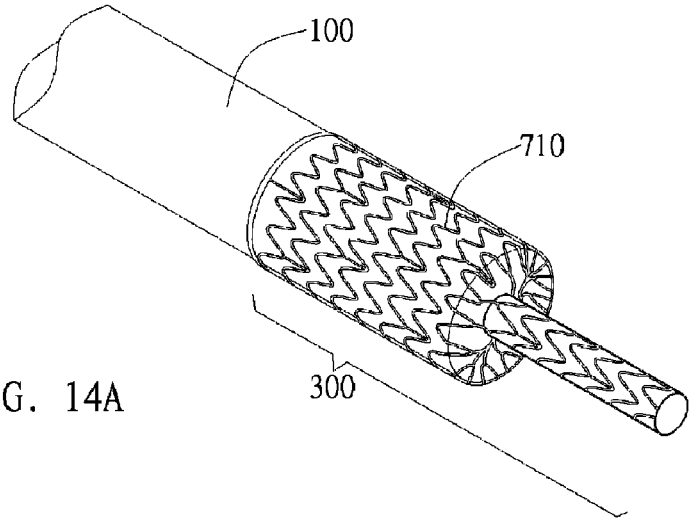
FIGS. 14A, 14B and 14C are schematic views illustrating different embodiments of the coil connecting tube.
Figure 14B:
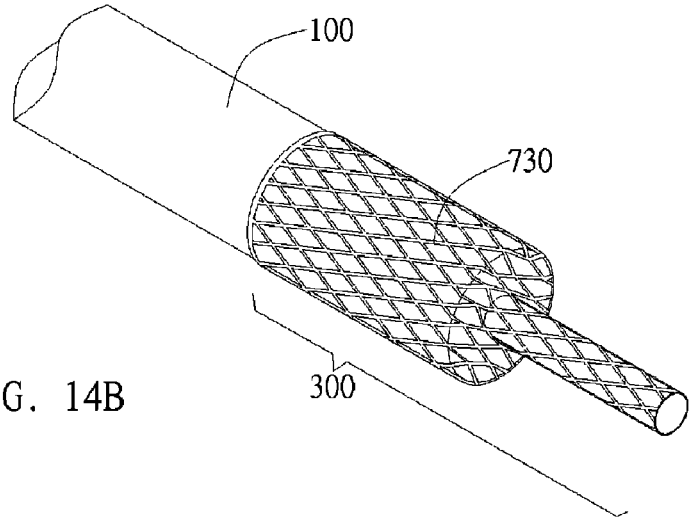
Figure 14C:
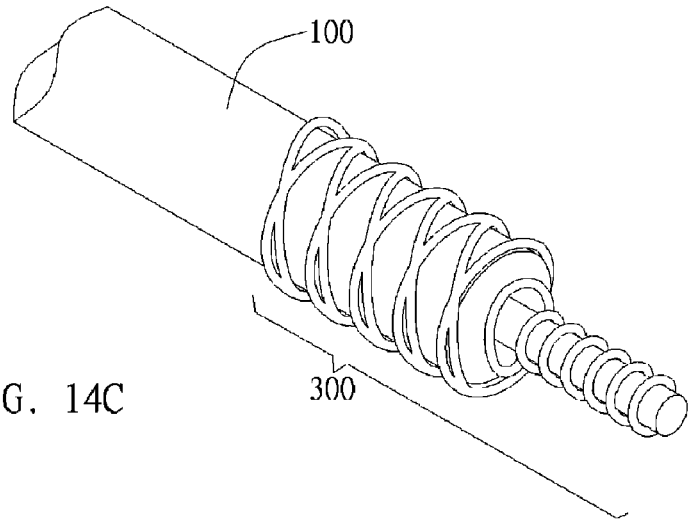

Other than the spring structure formed by coils, the coil connecting tube 300 can have different structures. As FIG. 14A shows, the coil connecting tube 300 includes a plurality of wave-shaped rings 710 and the rings 710 are axially connected to form the coil connecting tube 300. In the embodiment illustrated in FIG. 14B, the coil connecting tube 300 consists of a grid 730 which is used to provides electrical connection and protects the lamp body 100. In the embodiment illustrated in FIG. 14C, the coil connecting tube 300 has a dual spiral shape and is used to enclose the end portion of the lamp body 100.

The above is a detailed description of the particular embodiment of the invention which is not intended to limit the invention to the embodiment described. It is recognized that modifications within the scope of the invention will occur to a person skilled in the art. Such modifications and equivalents of the invention are intended for inclusion within the scope of this invention.

What is claimed is:

1. A lamp device, comprising:

a lamp body including an end portion and a lead wire extending from the end portion; and a coil connecting tube corresponding to the end portion and connected to the lead wire, wherein the coil connecting tube winds around the lamp body along an axial direction, the coil connecting tube is contractible along the axial direction, the coil connecting tube includes at least two expanding portions plus one neck portion alternately disposed or at least two neck portions plus one expanding portion alternately disposed, an average inner diameter of the expanding portion is greater than an average inner diameter of the neck portion.

2. The lamp device of claim 1, wherein the coil connecting tube at least partly surrounds the end portion.

3. The lamp device of claim 2, wherein a gap exists between an inner rim of the coil connecting tube surrounding the end portion and the end portion.

4. The lamp device of claim 2, wherein the lead wire winds around the end portion to form the coil connecting tube.

5. The lamp device of claim 2, wherein the coil connecting tube includes:

a lead wire segment winding about and electrically connected to the lead wire; and a lamp enclosing segment extending spirally from the lead wire segment toward the end portion and enclosing the end portion, wherein an average inner diameter of the lamp enclosing segment is greater than an average inner diameter of the lead wire segment.

6. The lamp device of claim 5, wherein the lead wire segment holds the lead wire.

7. The lamp device of claim 5, wherein the lead wire segment includes the neck portion electrically connected to the lead wire, the expanding portion extends from the lead wire segment opposite to the lamp enclosing segment and protruding axially away at the lead wire and the end portion to form an external extension.

8. The lamp device of claim 7, wherein an average inner diameter of the external extension is greater than the average inner diameter of the lead wire segment.

9. The lamp device of claim 8, wherein the inner diameter of the external extension gradually increases as a distance away from the lead wire segment increases.

10. The lamp device of claim 2, wherein the expanding portions and the neck portions are formed on the portion of the coil connecting tube surrounding the end portion.

11. The lamp device of claim 1, wherein the coil connecting tube includes a plurality of coils to form a spring structure, the end portion of the lamp body is inserted into the spring structure.

12. The lamp device of claim 11, wherein an interval exists between adjacent coils to allow the end portion to move axially relative to the coil connecting tube.

13. The lamp device of claim 11, wherein adjacent coils are in contact with each other along the axial direction.

14. The lamp device of claim 1, wherein the coil connecting tube is radially resilient relative to the lamp body.

15. A light source module, comprising:

a lamp body including an end portion and a lead wire extending from the end portion;

a coil connecting tube corresponding to the end portion and connected to the lead wire, wherein the coil connecting tube winds around the lamp body along an axial direction, the coil connecting tube is contractible along the axial direction, wherein the coil connecting tube includes at least two expanding portions plus one neck portion alternately disposed or at least two neck portions plus one expanding portion alternately disposed, an average inner diameter of the expanding portion is greater than an average inner diameter of the neck portion; and a lamp connector having a power source portion, wherein the coil connecting tube is electrically connected to the power source portion.

16. The light source module of claim 15, wherein the coil connecting tube at least partly surrounds the end portion, the power source portion includes a retainer for holding a portion of the coil connecting tube surrounding the end portion.

17. The light source module of claim 16, wherein a gap exists between an inner rim of the coil connecting tube surrounding the end portion and the end portion.

18. The light source module of claim 16, wherein the lead wire winds around the end portion to form the coil connecting tube.

19. The light source module of claim 16, wherein the coil connecting tube includes a lead wire segment winding about and electrically connected to the lead wire; and a lamp enclosing segment extending spirally from the lead wire segment toward the end portion and enclosing the end portion, wherein an average inner diameter of the lamp enclosing segment is greater than an average inner diameter of the lead wire segment, the retainer holds the lamp enclosing segment.

20. The light source module of claim 19, wherein the lead wire segment holds the lead wire.

21. The light source module of claim 15, wherein a coil connecting portion includes a plurality of coils to form a spring structure, the end portion of the lamp body is inserted into the spring structure.

22. The light source module of claim 21, wherein an interval exists between coils and the interval allows the end portion to axially move relative to the coil connecting tube.

23. The light source module of claim 21, wherein adjacent coils are in contact with each other along the axial direction.

24. The light source module of claim 15, wherein the coil connecting tube is radically resilient relative to the lamp body.

* * * * *